United States Patent [19]

Chen

[11] Patent Number: 4,951,542

[45] Date of Patent: Aug. 28, 1990

[54] ELECTRIC GUITAR NECK

[75] Inventor: Wen-Tsung Chen, Taoyuan, Taiwan

[73] Assignee: Tong Ho Musical & Wooden Works Co., Ltd., Taiwan, Taiwan

[21] Appl. No.: 398,912

[22] Filed: Aug. 28, 1989

[51] Int. Cl.[5] ..... G10D 1/08
[52] U.S. Cl. ..... 84/293
[58] Field of Search ..... 84/267, 293

[56] References Cited

U.S. PATENT DOCUMENTS

| | | | |
|---|---|---|---|
| 2,795,988 | 6/1957 | Maccaferri | 84/293 |
| 4,145,948 | 3/1979 | Turner | 84/293 |
| 4,313,362 | 2/1982 | Lieber | 84/267 |

*Primary Examiner*—Lawrence R. Franklin
*Attorney, Agent, or Firm*—Notaro & Michalos

[57] ABSTRACT

An electric guitar neck comprises a wood core; a fiber reinforced plastics coating enclosing the wood core; and a fingerboard adhered on the fiber reinforced plastics coating for supporting strings.

3 Claims, 1 Drawing Sheet

ELECTRIC GUITAR NECK

BACKGROUND OF THE INVENTION

1. Field of the Invention

This invention relates to an electric guitar neck, particularly, to an electric guitar neck having a wood core and a fiber reinforced plastic shell for preventing the electric guitar from twisting and transforming.

2. Description of the Prior Art

Conventionally, an electric guitar neck is made of wood. The manufacturing process of the known electric guitar neck comprises drying and molding the crude wood material into a predetermined shape. After a coating process, the electric guitar neck is achieved. However, in use, the known electric guitar neck of wood will be affected by moisture and climate to transform or twist the original shape. The quality of the known guitar is always reduced by this phenomena.

According to the disadvantage of the prior electric guitar neck, a known electric guitar neck is also made by carbon fiber reinforced plastic material. The manufacturing process of this type of electric guitar neck comprises coating the carbon fiber with plastic material, pressing the product generated into a predetermined shape and acheiving the necessary parts to form an electric guitar neck. The shape of the electric guitar neck made by fiber reinforced plastic material will not be varied with a change of temperature and moisture. However, since this known electric guitar includes a hollow neck, sound transmission is distored. Furthermore, the hollow neck of the known electric guitar should have a predetermined thickness to maintain the original shape, and therefore the manufacturing cost of this electric guitar neck is very expensive.

SUMMARY OF THE INVENTION

It is an object of this invention to provide an electric guitar neck made by a wood core and a fiber reinforced plastic shell. The properties and the shape of the present electric guitar neck will not be affected by temperature or moisture. The fidelity of this guitar is high.

The further object of this invention is to provide an electric guitar neck which is acid, base, and moisture resistance.

The other object of this invention is to provide an electric guitar neck wherein the manufacturing process thereof is very easily.

The fiber contained in the fiber reinforced plastic used in this invention is selected from glass or carbon fiber, and preferably, is carbon fiber. The plastic used in this invention is epoxy resins, phenolic resins, diallyl phthalate resins, furan resins, silicons, acrylate resins or polyamides, polyethylene. The plastic material preferably used in this invention is epoxy resins.

The electric guitar neck of this invention comprises a wood core; a fiber reinforced plastics coating enclosing said wood core; and a surface adhering on the fiber reinforced plastics coating for locating strings or the like. The inventor found that to apply a fiber reinforced plastic material on a wood core makes the electric guitar of this invention provide an effect which is superior to that of any prior art. While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

DESCRIPTION OF THE PREFERRED EMBODIMENTS

Figure 1:
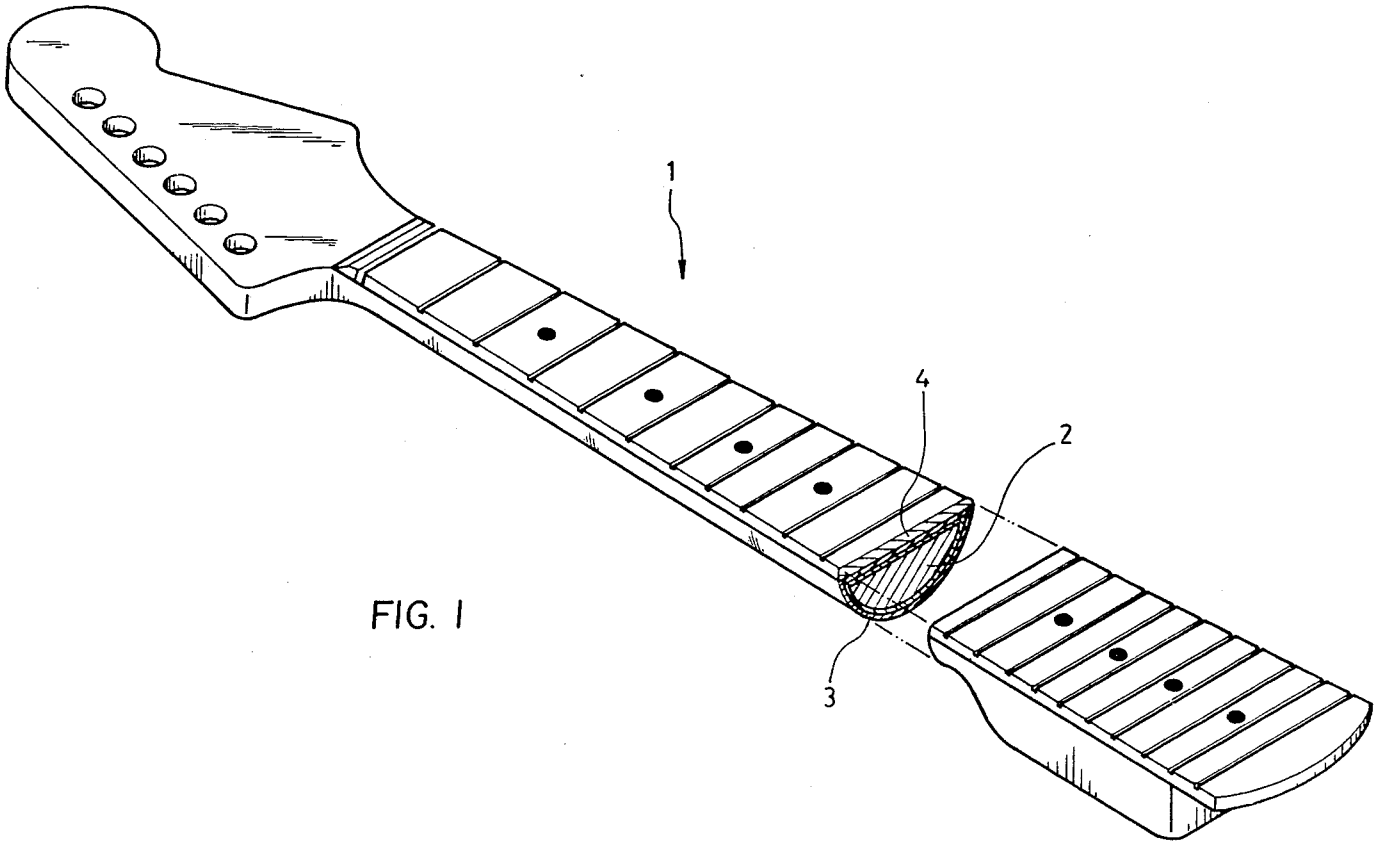
FIG. 1 is a perspective view showing a preferred embodiment of this invention wherein the electric guitar neck is partially in cross-sectional view.

Referring to the Drawing, the present electric guitar neck 1 comprises a wood core portion 2 and a fiber reinforced plastics coating 3. A fingerboard 4 is adhered on the fiber reinforced plastics coating 3 for supporting strings or the like thereon. The manufacturing process of the present electric guitar neck 1 comprises drying the crude wood and mechanical molding wood to the outer shape of the wood core portion 2. Carbon fibers is applied with epoxy resins to form fibers reinforced plastic. Fibers reinforced plastic 3 is applied on wood core 2 to form an outer shell by pressing molding. A fingerboard 4 for holding strings is adhered on the fiber reinforced plastic 3. Therefore, the electric guitar neck 1 of this invention is achieved.

While specific embodiments have been illustrated and described, numerous modifications come to mind without significantly departing from the spirit of the invention and the scope of protection is only limited by the scope of the accompanying claims.

What is claimed is:

1. An electric guitar neck, comprising:

a wood core;

a fiber reinforced plastics coating enclosing said wood core, the plastics contained in said fiber resinforced plastics coating being selected from epoxy resins, phenolic resins, diallyl phthalate resins, furan resins, silicone, acrylate resins, polyamides, and polyethylene, the fibers in said fiber reinforced plastics coating being selected from glass and carbon fibers; and a fingerboard adhered on said fiber reinforced plastics coating for supporting strings.

2. An electric guitar neck as claimed in claim 1, wherein said plastics is epoxy resins.

3. An electric guitar neck as claimed in claim 2, wherein said fiber reinforced plastics coating is applied to said wood core by a pressing molding method.

* * * * *